US011690773B2

(12) United States Patent
Song et al.

(10) Patent No.: US 11,690,773 B2
(45) Date of Patent: Jul. 4, 2023

(54) WEARABLE UPPER LIMB REHABILITATION TRAINING ROBOT WITH PRECISE FORCE CONTROL

(71) Applicant: SOUTHEAST UNIVERSITY, Nanjing (CN)

(72) Inventors: Aiguo Song, Nanjing (CN); Yiting Mo, Nanjing (CN); Huanhuan Qin, Nanjing (CN); Huijun Li, Nanjing (CN); Baoguo Xu, Nanjing (CN)

(73) Assignee: SOUTHEAST UNIVERSITY, Nanjing (CN)

( * ) Notice: Subject to any disclaimer, the term of this patent is extended or adjusted under 35 U.S.C. 154(b) by 416 days.

(21) Appl. No.: 16/969,198

(22) PCT Filed: Jun. 12, 2020

(86) PCT No.: PCT/CN2020/095734
§ 371 (c)(1),
(2) Date: Nov. 8, 2020

(87) PCT Pub. No.: WO2021/068543
PCT Pub. Date: Apr. 15, 2021

(65) Prior Publication Data

US 2021/0361515 A1 Nov. 25, 2021

(30) Foreign Application Priority Data

Oct. 12, 2019 (CN) ..... 201910968787.3

(51) Int. Cl.
*A61H 1/00* (2006.01)
*A61H 1/02* (2006.01)

(52) U.S. Cl.
CPC ... *A61H 1/0274* (2013.01); *A61H 2201/1207* (2013.01); *A61H 2201/165* (2013.01);
(Continued)

(58) Field of Classification Search
CPC ..... A61H 1/0274; A61H 2201/1207; A61H 2201/165; A61H 2201/1635;
(Continued)

(56) References Cited

U.S. PATENT DOCUMENTS 10,518,372 B2 * 12/2019 Bergeron ..... B25J 9/0006
10,610,438 B1 * 4/2020 Dines ..... B25J 9/0006
(Continued)

FOREIGN PATENT DOCUMENTS

CN 103519966 A 1/2014
CN 104826230 A 8/2015
(Continued)

OTHER PUBLICATIONS

Machine translation of written description and claims KR102140663B1 (Year: 2019).*
(Continued)

*Primary Examiner* — Philip R Wiest
*Assistant Examiner* — Tyler A Raubenstraw
(74) *Attorney, Agent, or Firm* — Bayramoglu Law Offices LLC

(57) ABSTRACT

A wearable upper limb rehabilitation training robot with precise force control includes a wearable belt, a multi-degree-of-freedom robot arm, and a control box. The robot is worn on the waist of a person by using a belt, and driven by active actuators, to implement active and passive rehabilitation training in such degrees of freedom as adduction/abduction/anteflexion/extension of left and right shoulder joints and anteflexion/extension of left and right elbow joints. In addition, a force/torque sensor is mounted on a tip of the robot arm, to obtain a force between the tip of the robot arm and the human hand during rehabilitation training
(Continued)

as a feedback signal, to adjust an operating state of the robot, thereby realizing the precise force control during the rehabilitation training.

14 Claims, 3 Drawing Sheets

(52) U.S. Cl.
CPC ..... *A61H 2201/1628* (2013.01); *A61H 2201/1635* (2013.01); *A61H 2201/1659* (2013.01); *A61H 2201/5061* (2013.01)

(58) Field of Classification Search
CPC .... A61H 2201/1659; A61H 2201/1628; A61H 2201/5061; A61H 2205/06; A61H 2201/16; A61H 1/00; B25J 9/16; A61F 5/00
See application file for complete search history.

(56) References Cited

U.S. PATENT DOCUMENTS

| | | | | |
|---|---|---|---|---|
| 11,260,530 | B2 * | 3/2022 | Sankai | B25J 13/082 |
| 11,324,995 | B2 * | 5/2022 | Mahoney | A63B 21/00181 |
| 2014/0142474 | A1 | 5/2014 | McBean et al. | |
| 2014/0296761 | A1 * | 10/2014 | Yamamoto | A61H 1/0244 602/23 |
| 2015/0217444 | A1 * | 8/2015 | Asada | B25J 9/0006 700/258 |
| 2017/0173783 | A1 * | 6/2017 | Angold | B25J 9/109 |
| 2017/0203432 | A1 * | 7/2017 | Andrianesis | A61F 5/013 |
| 2018/0272525 | A1 * | 9/2018 | Kumeno | B25J 9/1638 |
| 2019/0201273 | A1 * | 7/2019 | Soltanl-Zarrin | B25J 9/0006 |
| 2019/0240102 | A1 * | 8/2019 | Genani | B25J 9/0006 |
| 2019/0365554 | A1 * | 12/2019 | Davies-Sekle | A61H 1/0281 |
| 2020/0129360 | A1 * | 4/2020 | Ju | A61H 1/0288 |
| 2020/0206061 | A1 * | 7/2020 | Guo | B25J 9/0006 |
| 2020/0229960 | A1 * | 7/2020 | Romo | A61F 5/0123 |

FOREIGN PATENT DOCUMENTS

| | | | | |
|---|---|---|---|---|
| CN | 106393071 | A | | 2/2017 |
| CN | 106779045 | A | | 5/2017 |
| CN | 107632699 | A | | 1/2018 |
| CN | 107714398 | A | | 2/2018 |
| CN | 209092068 | U | * | 7/2019 |
| CN | 110652423 | A | | 1/2020 |
| EP | 1838270 | A2 | | 10/2007 |
| KR | 20170060854 | A | * | 11/2015 |
| KR | 102140663 | B1 | * | 7/2019 |
| WO | 2005075155 | A2 | | 8/2005 |

OTHER PUBLICATIONS

Machine translation of written description and claims CN209092068U (Year: 2019).*

Machine translation of written description and claims KR20170060854A (Year: 2015).*

* cited by examiner

WEARABLE UPPER LIMB REHABILITATION TRAINING ROBOT WITH PRECISE FORCE CONTROL

CROSS REFERENCE TO THE RELATED APPLICATIONS

This application is the national phase entry of International Application No. PCT/CN2020/095734, filed on Jun. 12, 2020, which is based upon and claims priority to Chinese Patent Application No. 201910968787.3, filed on Oct. 12, 2019, the entire contents of which are incorporated herein by reference.

TECHNICAL FIELD

The present invention relates to a wearable upper limb rehabilitation device, and in particular, to a wearable upper limb rehabilitation training robot with precise force control.

BACKGROUND

Senile diseases such as cerebral hemorrhage and cerebral apoplexy are increasing due to the rapid growth in older population, causing a difficult problem of limb movement disorder to contemporary rehabilitation medicine. Presently, the rehabilitation in the hospital mainly depends on medical workers to guide patients in rehabilitation training, which is time and energy consuming and costs much due to the need for manual assistance. In addition, some patients perform a large amount of repetitive rehabilitation training with simple mechanical devices, which can greatly reduce time and economic costs of the patients in terms of upper limb rehabilitation. However, most of the existing mechanical devices allow only passive training rather than actively driving the upper limb of the patient to move, which also have problems such as inappropriate structure, poor wearing comfort, and lack of safe and personalized movement planning.

SUMMARY

The present invention is directed to provide a portable and wearable rehabilitation training robot, to provide rehabilitation training with precise force control for left and right upper limbs of a wearer.

To resolve the foregoing technical problem, the following technical solutions are used in the present invention:

A wearable upper limb rehabilitation training robot with precise force control is provided, including:

a robot arm, including a base, a plurality of joints, and active actuators for driving the joints, where a force/torque sensor is mounted on a tip of the robot arm, to detect a force applied to an upper limb of a patient by the robot arm during rehabilitation training;

a wearable part, connected to the base of the robot arm, where the wearable part is preferably a belt made of a resin material; and a control box, including an actuator location reading module, an actuator driving module, a communication module, a power module, and a microcontroller, where the actuator location reading module is configured to read angular information of the active actuators, the actuator driving module is configured to convert an instruction of the microcontroller into an instruction executable by the active actuators, and the communication module controls bidirectional data communication between the robot arm and the control box, the data communication including active actuator data and force/torque sensor data, and the control box being preferably mounted on the wearable part.

During the rehabilitation training, a hand of the patient is in contact with the tip of the robot arm, the active actuators drive the joints to move, the tip of the robot arm applies the force to the hand, the actuator location reading module obtains the angular information of the active actuators, and transmits the angular information to the microcontroller, the force/torque sensor detects the force applied to the upper limb of the patient by the robot arm, and feeds back the force to the microcontroller, the microcontroller adjusts, according to the angular information and a magnitude of the force, an operating state of the active actuators, to realize precise control over the force during the rehabilitation training.

Further, the robot arm includes a left robot arm and a right robot arm, respectively mounted on a left side and a right side of the wearable part.

Further, the robot arm includes a horizontal rotary joint and at least two pitch joints, the joints are sequentially connected by using connecting members, the horizontal rotary joint is connected to the base, the pitch joints are sequentially connected after the horizontal rotary joint, and the force/torque sensor is mounted on a tip of a pitch joint farthest from the base. Preferably, the tip of the robot arm is a spheroidal handle, and the handle is provided for the patient to hold, or the handle is tied to the wrist of the patient by using a flexible rope.

Further, a through hole is provided on the front of the belt, and the belt is fastened to the waist of the patient by using a velcro tape fitting the through hole.

Further, the control box includes a current detection module, configured to monitor a feedback current of the active actuator in real time, and implement emergency power off.

Compared with the prior art, the present invention has the following significant advantages: The robot of the present invention has a compact structure, and is light and portable. The robot can be directly worn on a patient as a whole. The patient may implement active and passive rehabilitation training with a hand holding or being tied to the tip of the robot arm. The force during the rehabilitation training is precisely controlled by using the force/torque sensor, making the rehabilitation training more accurate, and improving the efficiency of the rehabilitation training. A training method is novel, more interesting, and more natural compared with conventional methods, and is of great research significance and practical value in improving the result of upper limb rehabilitation training. By combining the wearable robot with rehabilitation treatment, hospitalization is reduced, and the economic burden and time costs of users are also reduced.

DETAILED DESCRIPTION OF THE EMBODIMENTS

Technical solutions of the present invention are further described in detail below with reference to the accompanying drawings and embodiments.

Figure 1:
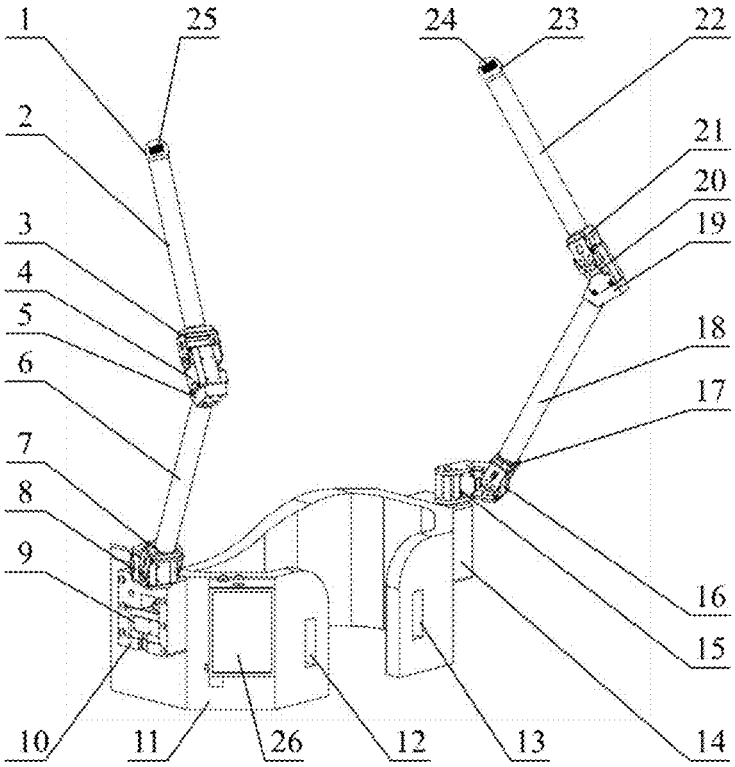
FIG. 1 is a schematic diagram of an overall structure of a three-degree-of-freedom upper limb rehabilitation training robot.

As shown in FIG. 1, a three-degree-of-freedom upper limb rehabilitation training robot is provided with left and right robot arms being mounted on a wearable belt, and a control box for controlling the robot to operate being encapsulated in the belt.

Specifically, the robot includes a tip 1 of the right robot arm, a second connecting rod 2 of the right robot arm, a connecting member 3 between a right third active actuator and the second connecting rod, the right third active actuator 4, a connecting member 5 between the right third active actuator and a first connecting rod, the first connecting rod 6 of the right robot arm, a connecting member 7 between the first connecting rod and a U-shaped bracket, a right second active actuator 8, a right first active actuator 9, a base 10 of the right robot arm, the wearable belt 11, a first velcro tape mounting hole 12, a second velcro tape mounting hole 13, a base 14 of the left robot arm, an L-shaped two-layer connecting member 15, a left second active actuator 16, a connecting member 17 between the left second active actuator and a first connecting rod, the first connecting rod 18 of the left robot arm, a connecting member 19 between a left third active actuator and the first connecting rod, a left third active actuator 20, a connecting member 21 between the first connecting rod and a U-shaped bracket, a second connecting rod 22 of the left robot arm, a tip 23 of the left robot arm, a force/torque sensor 24 on the tip of the left robot arm, a force/torque sensor 25 on the tip of the right robot arm, and a control box 26. The bases 10 and 14 of the robot arms are screwed on two sides of the belt 11 as base points of movement. The right first active actuator 9 is mounted in the base 10 with the axis being vertically upward, and is connected to the right second active actuator 8 by using a connecting member. The connecting rod 6 is provided between the right second active actuator 8 and the right third active actuator 4. The right third active actuator 4 is then connected to the connecting rod 2, and the connecting rod 2 is provided with the tip 1 of the robot arm. Therefore, the robot obtains three degrees of freedom in space, and can meet the basic requirement of human upper limb movement.

Figure 2:
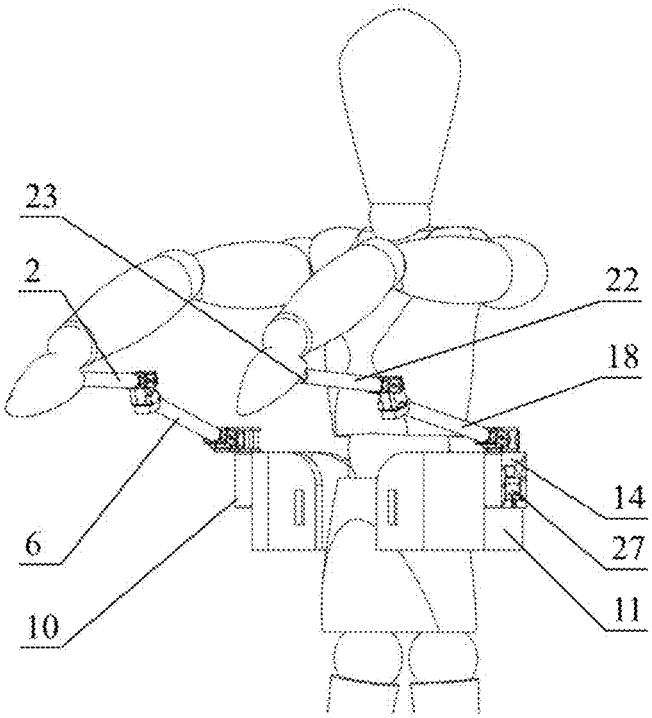
FIG. 2 is a schematic diagram of an effect of wearing the robot in FIG. 1.

As shown in FIG. 2, in practical application, the robot is worn on the human waist, and the robot may suit sizes of different people by being fastened to the waist by using a velcro tape. A patient may hold the tips 1 and 23 of the robot arms by hand, or tie the tips of the robot arms to the wrists with flexible ropes. Different from common rehabilitation training robots, the robot of the present invention does not require a motion sensing device to capture actions. The robot may obtain corresponding hand position information through calculate by using angular information of three joints, and implement closed loop control by using the force/torque sensors on the tips of the robot arms, to adjust an operating state of the robot, and realize precise force control during rehabilitation training.

Figure 3:
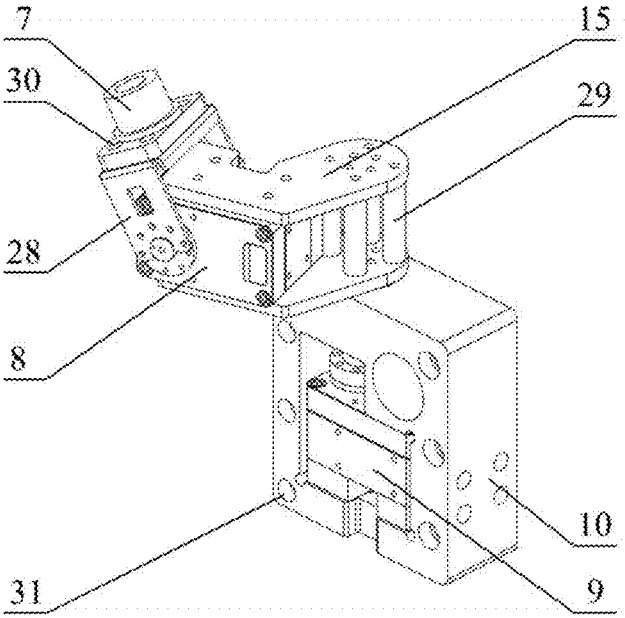
FIG. 3 is a schematic structural diagram of assembled pieces of a horizontal rotary joint and a first pitch joint of the robot in FIG. 1.

FIG. 3 is a schematic structural diagram presenting assembled pieces of a horizontal rotary joint and a first pitch joint, including a U-shaped bracket 28 of the second active actuator, a support 29 of the two-layer connecting member, a mounting hole 30 of the connecting member, and a mounting hole 31 of the base.

The first pitch joint is assembled as follows: The connecting member 7 is mounted on the U-shaped bracket 28 through the mounting hole 30, and has an end screwed to the first connecting rod 6 or 18. The U-shaped bracket 28 is mounted on the axis of the active actuator, and rotates around the axis. The horizontal rotary joint is assembled as follows: The L-shaped two-layer connecting member 15 has an end clamping the second active actuator, and an end with four supports connecting upper and lower layers. The center of the four supports are aligned with the axis of the first active actuator. In this way, the L-shaped two-layer connecting member 15 rotates around the axis of the first active actuator, and the second active actuator mounted in the L-shaped two-layer connecting member 15 also rotates around the axis of the first active actuator.

Figure 4:
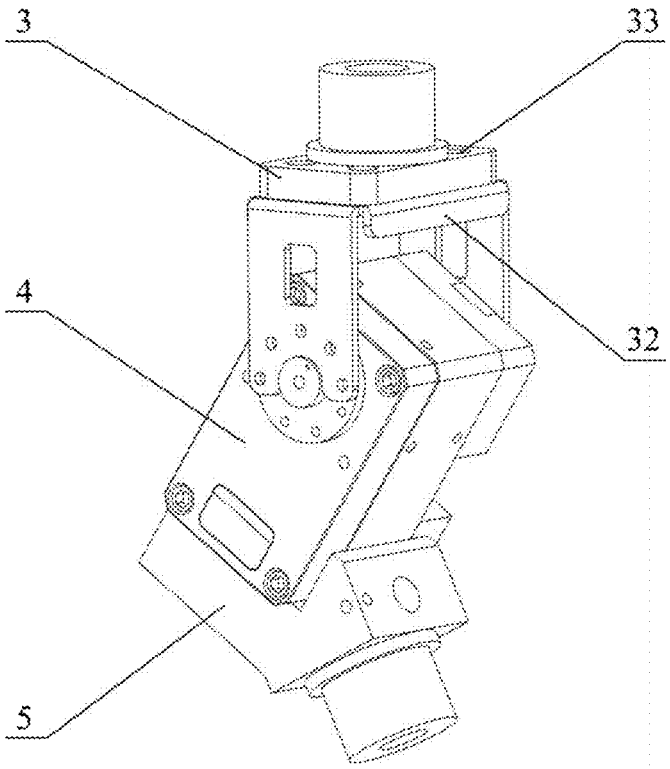
FIG. 4 is a schematic structural diagram of assembled pieces of a second pitch joint of the robot in FIG. 1.

FIG. 4 is a schematic structural diagram presenting assembled pieces of a second pitch joint, including a U-shaped bracket 32 of the third active actuator, and a mounting hole 33 of the connecting member.

The U-shaped bracket 32 is mounted on the axis of the third active actuator, and rotates around the axis. The connecting member 3 mounted on the U-shaped bracket 32 is screwed to the second connecting rod, to form the second pitch joint.

The wearable upper limb rehabilitation training robot designed according to the embodiments guides upper limbs of a patient by using six active actuators 4, 8, 9, 16, 20, and 27, to implement personalized rehabilitation training at such degrees of freedom as adduction/abduction/anteflexion/extension of left and right shoulder joints and anteflexion/extension of left and right elbow joints. The robot does not require complex and repetitive manual assistance, thus reducing economic and psychological burdens of the patient.

In addition, a force/torque sensor is mounted on the tip of each of the left and right robot arms, to obtain a force between the tip of the robot arm and the human hand during rehabilitation training as a feedback signal, to adjust an operating state of the robot, thereby realizing precise force control during the rehabilitation training. The robot does not require an additional motion sensing device. The integrated wearable design can ensure safe and stable operation of the robot.

What is claimed is:

1. A wearable upper limb rehabilitation training robot with precise force control, comprising:

a robot arm, comprising a base, a plurality of joints, a plurality of active actuators for driving the plurality of joints, and a rigid L-shaped connecting member, wherein a first end of the L-shaped connecting member is coupled to the base, on which a first active actuator of the plurality of actuators is mounted and is configured to rotate the L-shaped connecting member around a first axis at the first end as a first joint of the plurality of joints, and a second end of the L-shaped connecting member is coupled to a bracket that is connected to a connecting rod of the robot arm, wherein a second active actuator of the plurality of active actuators is mounted on the L-shaped connecting member and is configured to rotate the bracket around a second axis that is oriented differently from said first axis as a second joint of the plurality of joints, and wherein a force/torque sensor is mounted on a tip of the robot arm, to detect a force applied to an upper limb of a patient by the robot arm during rehabilitation training;

a wearable part, connected to the base of the robot arm; and a control box, comprising an actuator location reading module, an actuator driving module, a communication module, a power module, and a microcontroller, wherein the actuator location reading module is configured to read angular information of the plurality of active actuators, the actuator driving module is configured to convert an instruction of the microcontroller into an instruction executable by the plurality of active actuators, and the communication module controls bidirectional data communication between the robot arm and the control box, the bidirectional data communication comprising active actuator data and force/torque sensor data;

wherein during the rehabilitation training, the tip of the robot arm is configured to be in contact with a hand of the patient, the plurality of active actuators drive the plurality of joints to move, the tip of the robot arm is configured to apply the force to the hand, the actuator location reading module obtains the angular information of the plurality of active actuators, and transmits the angular information to the microcontroller, the force/torque sensor detects the force applied to the upper limb of the patient by the robot arm, and feeds back the force to the microcontroller, the microcontroller adjusts, according to the angular information and a magnitude of the force, an operating state of the plurality of active actuators, to realize the precise force control during the rehabilitation training.

2. The wearable upper limb rehabilitation training robot according to claim 1, wherein the robot arm comprises a left robot arm and a right robot arm, the left robot arm is mounted on a left side of the wearable part, and the right robot arm is mounted on a right side of the wearable part.

3. The wearable upper limb rehabilitation training robot according to claim 1, wherein the first joint is a horizontal rotary joint and the plurality of joints comprises at least two pitch joints, one of which is the second joint, the plurality of joints are sequentially connected by using connecting members that include the L-shaped connecting member, the horizontal rotary joint is connected to the base, the at least two pitch joints are sequentially connected to a rear of the horizontal rotary joint, and the force/torque sensor is mounted on a tip of a top pitch joint of the at least two pitch joints, wherein the top pitch joint of the at least two pitch joints is farthest from the base.

4. The wearable upper limb rehabilitation training robot according to claim 3, wherein the tip of the robot arm is a spheroidal handle, and the spheroidal handle is provided for the patient to hold, or the spheroidal handle is tied to a wrist of the patient by using a flexible rope.

5. The wearable upper limb rehabilitation training robot according to claim 1, wherein the wearable part is a belt.

6. The wearable upper limb rehabilitation training robot according to claim 5, wherein the belt is made of a resin material.

7. The wearable upper limb rehabilitation training robot according to claim 5, wherein a through hole is provided on a front of the belt, and the belt is fastened to a waist of the patient by using a velcro tape fitting the through hole.

8. The wearable upper limb rehabilitation training robot according to claim 1, wherein the control box is mounted on the wearable part.

9. The wearable upper limb rehabilitation training robot according to claim 1, wherein the control box comprises a current detection module, the current detection module is configured to monitor a feedback current of the plurality of active actuators in real time, and implement emergency power off.

10. The wearable upper limb rehabilitation training robot according to claim 2, wherein the first joint is a horizontal rotary joint and the plurality of joints comprises at least two pitch joints, one of which is the second joint, the plurality of joints are sequentially connected by using connecting members that include the L-shaped connecting member, the horizontal rotary joint is connected to the base, the at least two pitch joints are sequentially connected to a rear of the horizontal rotary joint, and the force/torque sensor is mounted on a tip of a top pitch joint of the at least two pitch joints, wherein the top pitch joint of the at least two pitch joints is farthest from the base.

11. The wearable upper limb rehabilitation training robot according to claim 10, wherein the tip of the robot arm is a spheroidal handle, and the spheroidal handle is provided for the patient to hold, or the spheroidal handle is tied to a wrist of the patient by using a flexible rope.

12. The wearable upper limb rehabilitation training robot according to claim 11, wherein the training robot is configured such that the base is mounted on a belt configured to be worn at a waist of the patient and the belt primarily bears the weight of the robot arm.

13. The wearable upper limb rehabilitation training robot according to claim 4, wherein the training robot is configured such that the base is mounted on a belt configured to be worn at a waist of the patient and the belt primarily bears the weight of the robot arm.

14. The wearable upper limb rehabilitation training robot according to claim 1, wherein the bracket is a U-shaped bracket including a mounting hole through which an additional connecting member is mounted to the bracket, wherein the additional connecting member is connected between the connecting rod and the U-shaped bracket.

* * * * *